US010099906B2

(12) United States Patent
Smith et al.

(10) Patent No.: US 10,099,906 B2
(45) Date of Patent: Oct. 16, 2018

(54) VEHICLE TOP LIFT AND STORAGE SYSTEM

(71) Applicant: LANGE ORIGINALS, LLC, Salt Lake City, UT (US)

(72) Inventors: Carter Smith, Salt Lake City, UT (US); Tobin Gunderson, Salt Lake City, UT (US)

(73) Assignee: LANGE ORIGINALS, LLC, Salt Lake City, UT (US)

( * ) Notice: Subject to any disclaimer, the term of this patent is extended or adjusted under 35 U.S.C. 154(b) by 0 days.

(21) Appl. No.: 14/732,338

(22) Filed: Jun. 5, 2015

(65) Prior Publication Data

US 2016/0355382 A1 Dec. 8, 2016

(51) Int. Cl.
*B66C 23/48* (2006.01)
*A47B 81/00* (2006.01)

(52) U.S. Cl.
CPC ..... *B66C 23/48* (2013.01); *A47B 81/00* (2013.01)

(58) Field of Classification Search
CPC ..... B66D 3/04; Y10T 29/53974; B66C 23/48; B66C 23/36; B66C 23/44; A47B 81/00; B62H 3/12
USPC ..... 211/85.8
See application file for complete search history.

(56) References Cited

U.S. PATENT DOCUMENTS 1,512,149 A 10/1924 Wagner
2,541,449 A * 2/1951 Vickers ..... A45F 5/10 294/149
4,248,469 A 2/1981 Knox
4,576,542 A 3/1986 Brasell
4,899,985 A 2/1990 Good
4,941,645 A * 7/1990 Hall ..... B62B 3/0637 254/324
5,081,775 A 1/1992 Veilleux
5,335,836 A 8/1994 Waddell
5,375,963 A * 12/1994 Wohlwend ..... B66C 23/48 212/203
5,782,459 A 7/1998 Klann
5,823,412 A 10/1998 Haug
5,897,104 A * 4/1999 Garbiso ..... B66C 1/18 248/327
5,993,137 A 11/1999 Harr
6,152,427 A 11/2000 Hoslett
(Continued)

FOREIGN PATENT DOCUMENTS

WO 2007130062 11/2007

OTHER PUBLICATIONS

Installation Instruction/Hoist-a-Top 2 Door JK.
(Continued)

*Primary Examiner* — Ko H Chan
(74) *Attorney, Agent, or Firm* — Maschoff Brennan

(57) ABSTRACT

A vehicle top lift and storage system is disclosed herein. In one embodiment a vehicle top lift and storage system includes a base, an upright member coupled to the base, and a lift arm coupled to and extending away from the upright member. A lift mechanism is configured to attach to a vehicle top and to suspend the vehicle top from the lift arm in order to aid removal of the vehicle top from a vehicle. A retainer, coupled to the base, is configured to engage at least a portion of a vehicle top when the vehicle top is resting on the vehicle top lift and storage system in a storage position.

20 Claims, 9 Drawing Sheets

(56) References Cited

U.S. PATENT DOCUMENTS

| | | | | |
|---|---|---|---|---|
| 6,164,625 | A * | 12/2000 | Shockley | B66C 23/48 254/8 B |
| 6,357,810 | B1 | 3/2002 | Schwulst | |
| 6,685,170 | B1 * | 2/2004 | Gwynn | B66C 5/025 254/325 |
| 7,004,697 | B2 | 2/2006 | Alaweih | |
| 7,568,678 | B2 | 8/2009 | Hammond | |
| 7,581,713 | B1 * | 9/2009 | Voss | B66F 3/25 254/2 B |
| 7,726,182 | B1 * | 6/2010 | Newlin | G01M 15/02 73/116.01 |
| 8,033,529 | B2 * | 10/2011 | Boda | B62H 3/12 254/372 |
| 8,056,883 | B1 * | 11/2011 | Brockie | B66D 3/04 254/278 |
| 8,556,311 | B1 | 10/2013 | Lucero | |
| 8,641,355 | B2 | 2/2014 | Pawlak | |
| 9,016,741 | B1 | 4/2015 | Thoreson et al. | |
| 2006/0261320 | A1 | 11/2006 | Crawford | |
| 2007/0163982 | A1 | 7/2007 | Linchini | |
| 2009/0309079 | A1 | 12/2009 | Lacina | |
| 2013/0280020 | A1 | 10/2013 | O'Brien et al. | |

OTHER PUBLICATIONS

Installation Instruction/Hoist-a-Top 4 Door JK.

Deluxe Heavy Duty Hardtop Storage Cart for 07-16 Jeep(R) Wrangler & Wrangler Unlimited JK—Quadratec.

Bestop Hoss(tm) Hardtop & Door Carrier Combo* for 07-16 Jeep(R) Wrangler & Wrangler Unlimited JK—Quadratec.

Mopar(R) Hard Top Storage Dolley for 07-12 Jeep(R) Wrangler JK 2 Door—Quadratec.

Innovative Tools, Auto Body Truck Bed Lift Set Up & Usage Guide, Instructional Video, published Nov. 21, 2012, accessed on Feb. 23, 2017 at https://www.youtube.com/watch?v=jJkz9lcj-0w.

Rightline Gear Car Clips, Instructional Video,published Oct. 30, 2013, accessed on Feb. 23, 2017 at https://www.youtube.com/watch?v=eYzZYiSzU-A.

Sema Show 2013 product showcase webpage; Smittybilt Jeep Hard Top Hoist; accessed at http://www.semaphotos.com/netpub/server.np?find&catalog=catalog&template=detail.np&field=itemid&op=matches&value=6182&site=photolibrary13&image=C_3236.JPG&make=Jeep&model=&company=Pro Comp/Smittybilt/Rubicon Express/G2 Axle & Gear&product=Smittybilt Jeep Hard Top Hoist&show=[undefined].

* cited by examiner

VEHICLE TOP LIFT AND STORAGE SYSTEM

BACKGROUND OF THE INVENTION

1. The Field of the Invention

The present invention relates generally to removable vehicle tops, and more particularly, to a system for removal, attachment, or storage of a removable vehicle top.

2. The Relevant Technology

Passenger, utility, and other vehicles typically include an enclosed cabin in which the vehicle occupants may sit while traveling in the vehicle. The enclosure protects passengers from the wind, weather, and other elements that may be undesirable while operating a vehicle. However, at times passengers may wish to remove portions of the enclosure to enjoy favorable weather, to have greater visibility of the environment surrounding a vehicle, or for other reasons. Accordingly, some vehicles include removable tops that allow vehicle owners to remove part of the enclosure, typically the top, rear, sides, or any combination thereof. Some vehicles may also allow for the removal of other parts of the vehicle such as the doors. Vehicle owners may then selectively remove a vehicle's top, for example, during favorable weather or seasons, and then replace the vehicle top, for example, during unfavorable weather or stormy seasons.

Removable vehicle tops come in a variety of shapes and sizes. The shape and size of a removable vehicle top may be dependent on the shape and size of the underlying vehicle. Some removable vehicle tops are rigid to provide strength and extra protection from adverse weather. Other removable tops may be constructed of flexible materials. Some removable vehicle tops are removable as a unitary piece, and others are removable in multiple pieces. A removable vehicle top may have any combination of these characteristics.

Removable vehicle tops may often be bulky and heavy such that it is a challenge for vehicle owners to easily remove, reattach, or store the removable vehicle tops for their vehicles. What is needed is a versatile system to assist vehicle owners with the removal, reattachment, and storage of a variety of removable vehicle tops.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter.

A vehicle top lift and storage system is disclosed herein. In one embodiment a vehicle top lift and storage system includes a base, an upright member coupled to the base, and a lift arm coupled to and extending away from the upright member. A lift mechanism is configured to attach to a vehicle top and to suspend the vehicle top from the lift arm in order to aid removal of the vehicle top from a vehicle. The suspended vehicle top may then be lowered at least partially onto the base of the vehicle top lift and storage system. A retainer, coupled to the base, is configured to engage at least a portion of a vehicle top when the vehicle top is resting on the vehicle top lift and storage system in a storage position.

Other aspects of certain embodiments of a vehicle top lift and storage system are also disclosed. These aspects include, among other things, accessory storage mechanisms, mechanisms to reduce the size of a vehicle top lift and storage system, and mechanisms to aid the removal of a vehicle top from a vehicle.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. These drawings depict only typical embodiments of the invention and are therefore not to be considered limiting of its scope. The invention will be described and explained with additional specificity and detail through the use of the accompanying drawings in which.

DETAILED DESCRIPTION

Exemplary embodiments of vehicle top lift and storage systems and components and methods for using the same will now be described with reference to the Figures. The illustrated and described embodiments are exemplary only, and one of skill in the art will recognize many variations of the described embodiments within the scope of the claims.

Figure 1:
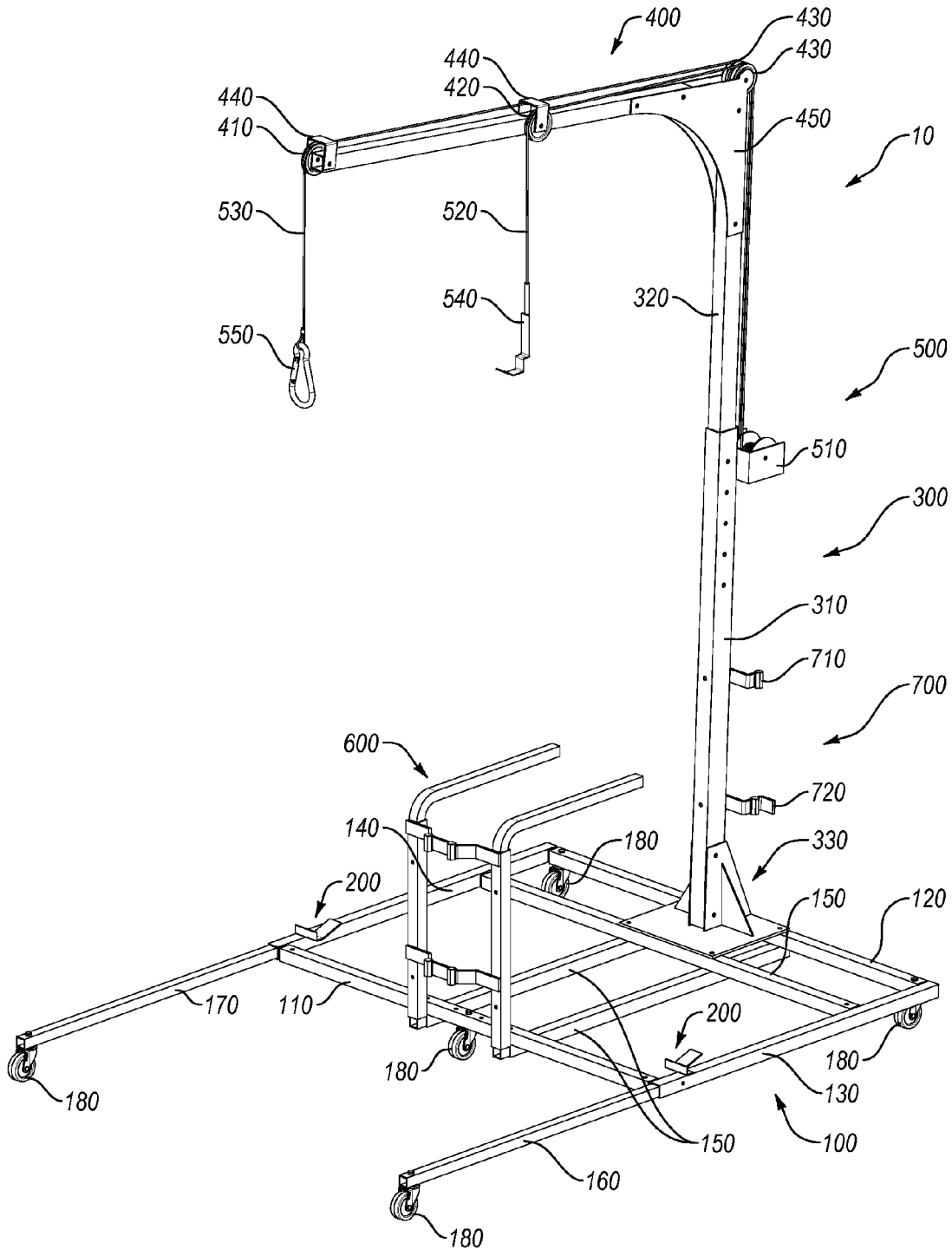
FIG. 1 is a perspective view of a vehicle top lift and storage system.

With reference first to FIG. 1, FIG. 1 shows one embodiment of a vehicle top lift and storage system 10. Vehicle top lift and storage system 10 includes base 100, retainers 200, upright member 300, lift arm 400, lift mechanism 500, accessory storage module 600, and door holder 700. Vehicle top lift and storage system 10 is shown as being made primarily of metal components. In other embodiments, the components of a vehicle top lift and storage system may be made from any combination of metals, plastics, PVC, composite materials, or any other material known to those of skill in the art to be of sufficient character to lift and store a vehicle top.

Base 100 includes a front side 110, rear side 120, left side 130, and right side 140. Base 100 is also shown with support members 150. Support members 150 provide structural support to base 100 or to the other components of the vehicle top lift and storage system 10. As shown in FIG. 1, base 100 may be comprised of multiple pieces of tubular steel that are joined together through the use of fasteners, bolts, suitable adhesives, welds, or other means of attachment. Alternatively, a base may be comprised of a unitary frame into any shape suitable for use of the vehicle top lift and storage systems described herein.

Base arm 160 and base arm 170 are shown attached to base 100. Base arm 160 couples with left side 130 by the insertion of base arm 160 into the hollow portion of left side 130. Base arm 170 also is shown coupled to right side 140 by the insertion of base arm 170 into the hollow portion of right side 140. Base arm 160 and base arm 170 are selectively extendible between an extended position, as shown in FIG. 1, and a retracted position, shown in FIG. 6. Base arm 160 or base arm 170 may be temporarily locked into an extended position or a retracted position through the use of depressible push-pins connected to base arm 160 or base arm 170 interacting with holes in left side 130 or right side 140, respectively. Alternatively, other temporary fasteners or mechanisms may be used. For example, in other embodiments, pins may be inserted through a base arm and a side of the base in order to lock the base arm in position. The pin may then be removed to move the base arm to a different position. Any other number of fasteners may be used to secure base arms to a base at various positions. For example, screws, bolts, pins, ties, friction-fit, or other fasteners may be used to selectively extend the length of a base arm with respect to a base.

While base arm 160 and base arm 170 are shown as connecting to left side 130 and right side 140, respectively, base arms may be configured to connect to other members of base 100, such as through receptacles in front side 110, receptacles in support members 150, or at other positions. In other embodiments, base arms may be place in a retracted position by folding or rotating base arms inward toward the base.

FIG. 1 also shows retainers 200 connected to base 100. Retainers 200 are configured to receive, abut, or otherwise limit unwanted movement of at least a portion of a vehicle top stored on vehicle top lift and storage system 10. Retainers 200 will be described further with reference to the other figures.

Wheels 180 are attached to base 100 to facilitate the movement of base 100 from one location to another. Wheels 180 are also shown connected to base arm 160 and base arm 170. Wheels 180 may be of any type sufficient to support the use of vehicle top lift and storage system 10 as described herein. For example wheels 180 may be locking wheels with a locking switch that may be operated by a person's foot to selectively lock and unlock the ability of the wheels to rotate.

Upright member 300 extends away from base 100 and includes a lower portion 310 and an upper portion 320. Lower portion 310 and upper portion 320 are connected together by inserting upper portion 320 into hollow lower portion 310. Lower portion 310 is shown as connected to base 100 with a bracket 330 configured to couple base 100 and lower portion 310. Bracket 330 may also be configured to provide additional rigidity and support in order to limit unwanted movement of upright member 300 during use of vehicle top lift and storage system 10. While upright member 300 may comprise multiple portions, an upright member could comprise a single portion.

Upright member 300 may also be selectively extendible between a heightened position and a lowered position by, for example, adjusting the extension of upper portion 320 out of lower portion 310. Lower portion 310 and upper portion 320 may be temporarily locked into a heightened position or a lowered position through the use of depressible push-pins, rigid pins, screws, bolts, ties, or other fasteners or mechanisms. A heightened position of upright member 300 may be used to accommodate the removal of vehicle tops from larger vehicles or to otherwise position a vehicle top lift and storage system for use to remove a vehicle top from a vehicle. A lowered position of upright member 300 may be used to accommodate removal of vehicle tops from small vehicles or to reduce the overall size of a vehicle top lift and storage system while a vehicle top is being stored thereon.

Lift arm 400 is shown connected to the upper portion 320 of upright member 300. Like other components of vehicle top lift and storage system 10, lift arm 400 may comprise multiple parts or be a single piece, and lift arm 400 may be a single length or be selectively extendible through the use of multiple interacting pieces as already described herein. Reinforcement plates 450 assist in connecting lift arm 400 to upright member 300. Reinforcement plates 450 may also be configured to limit unwanted movement of lift arm 400 during use of vehicle top lift and storage system 10.

Pulleys 410, 420, 430 are connected along lift arm 400 to facilitate the operation and movement of cables 520, 530 of lift mechanism 500. Pulley 410 is attached to lift arm 400 at a forward position, and pulley 420 is attached to lift arm 400 at a rear position, which is closer to upright member 300 than the forward position of pulley 410. In some embodiments, pulleys 410, 420 may be selectively movable along lift arm 400 through connection of pulleys 410, 420 at different possible attachment positions along lift arm 400. Additional pulleys, such as pulleys 430, may also be used in connection with a vehicle top lift and storage system in order to facilitate the operation and movement of cables. Pulley brackets 440, or similar mechanisms, may also be used in connection with pulleys 410, 420, 430 in order to limit unwanted movement or slipping of cables that are used in connection with pulleys 410, 420, 430. Retention mechanisms similar to pulley brackets 440 could be used at any point to protect or otherwise limit interference with cables or other lifting mechanisms of vehicle top lift and storage system 10.

Lift mechanism 500 comprises winding mechanism 510, rear cable 520, front cable 530, rear hook 540, and carabineer 550. As will be described in further detail with respect to the other figures, lift mechanism 500 may be used to raise a vehicle top up and away from a vehicle. Also, "lift mechanism" may refer generally to any components that are used in connection with the vehicle top lifting function provided by vehicle top lift and storage system 10.

Rear cable 520 and front cable 530 are connected to winding mechanism 510 and run along the upright member 300 and lift arm 400 to suspend from lift arm 400 at rear pulley 420 and front pulley 410, respectively. In other embodiments, the rear cable 520 and front cable 530 may be a wire, rope, belt, or strap. The selection of a cable or other material used in connection with a vehicle top lift and storage system will depend on a particular application.

Winding mechanism 510 may be a hand operated worm gear, spur gear, or sprocket gear system. In other embodiments, winding mechanism 510 may be an electronic gear system. In yet other embodiments, winding mechanism 510 may be a ratchet, winch, or hoist. Winding mechanism 510 is used to lengthen and shorten the length of rear cable 520, front cable 530, or both rear cable 520 and front cable 530. As shown, winding mechanism 510 may be used in connection with rear cable 520 and front cable 530 jointly. Alternatively, multiple winding mechanisms may be used in connection with the cables of a lift mechanism. Additionally, while lift mechanism 500 is described in connection with multiple cables, a lift mechanism for use with a vehicle top lift and storage system may only comprise a single cable.

FIG. 1 shows accessory storage module 600 connected to base 100. Accessory storage module 600 may be used for the storage of vehicle doors, additional vehicle top pieces, or other accessories to be stored with a vehicle top using vehicle top lift and storage system 10. Accessory storage module 600 may be removed from vehicle top lift and storage system 10, while a vehicle top is being removed from its vehicle, and accessory storage module 600 may be attached to vehicle top lift and storage system 10, when a vehicle top is being stored on vehicle top lift and storage system 10 or at other times. Accessory storage module 600 may be selectively connected to base 100 through any of the various attachment means described herein, including depressible push pins, screws, bolts, pins, ties, friction-fit, or other fasteners. While accessory storage module is shown attached through the hollow portions of support members 150, an accessory storage module for use with a vehicle top lift and storage system may be attached to the vehicle top lift and storage system at any suitable connection point.

FIG. 1 also shows door holder 700 connected to upright member 300 of vehicle top lift and storage system 10. Door holder 700 may be used for the storage of vehicle doors. Door holder 700 may be connected to upright member 300 through the use of screws, bolts, pins, ties, welds, suitable adhesives, or other attachment means. The configuration and use of door holder 700 will be further described with reference to the other figures.

Figure 2:
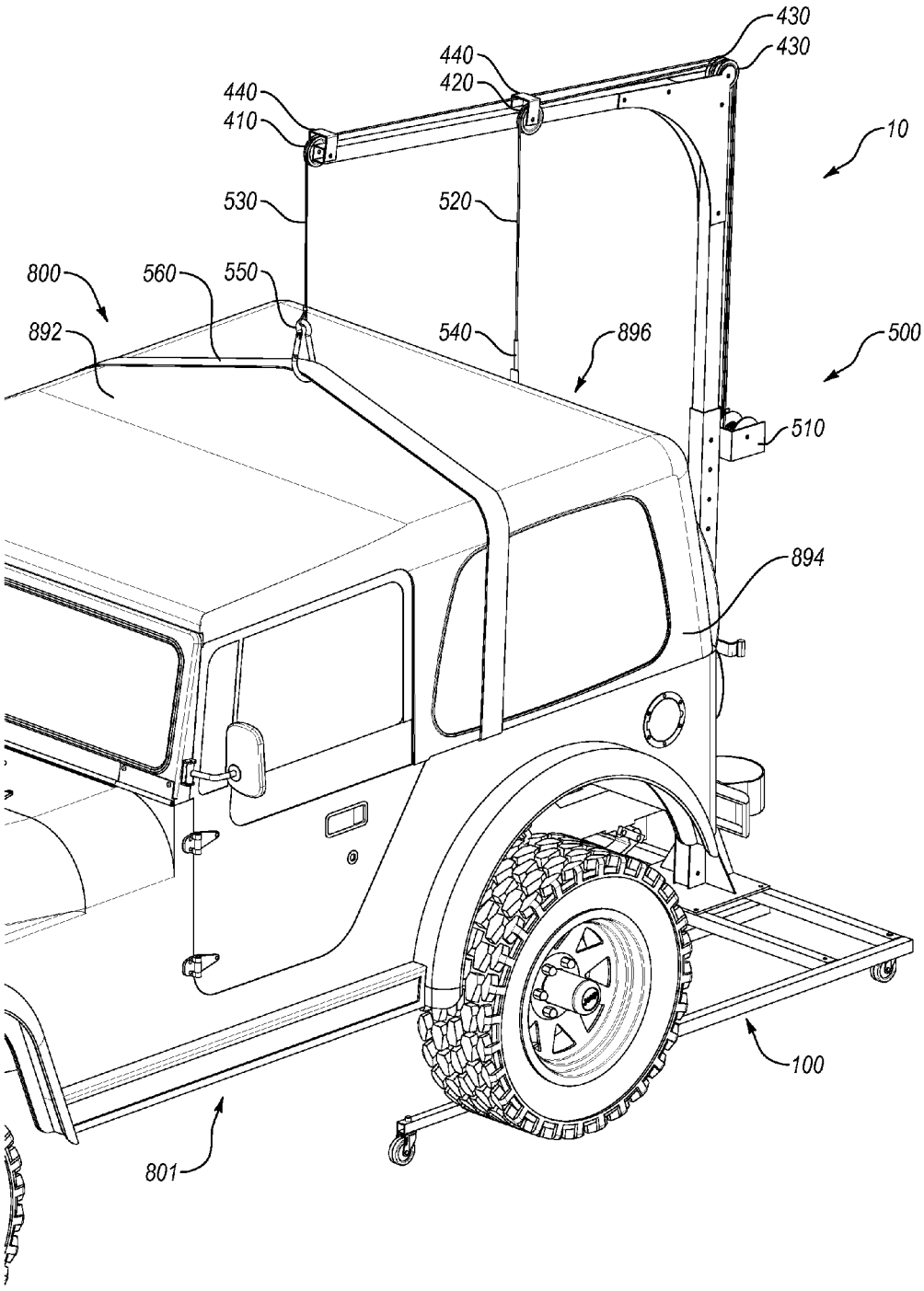
FIG. 2 is another perspective view of a vehicle top lift and storage system in which a vehicle is positioned for use in connection with the vehicle top lift and storage system.

FIG. 2 shows one embodiment of vehicle top lift and storage system 10 used in connection with the removal of vehicle top 800 from vehicle 801. The vehicle 801 in FIG. 2 is a utility vehicle. However, a vehicle top lift and storage system may be used with any type of vehicle, including, but not limited to, passenger vehicles, sports vehicles, utility vehicles, compact vehicles, vans, buses, boats, watercraft, and other vehicles, whether motorized or manually propelled. Vehicle top 800 may comprise roof 892, sides 894, and rear 896. The rear 896 of vehicle top 800 may also include a rear window 898, and sides 894 may also include windows or other decoration.

In FIG. 2, vehicle top lift and storage system 10 is partially positioned under vehicle 801. For example, base arm 160 and base arm 170 extend under vehicle 801. A portion of base 100 may also extend under vehicle 801. Vehicle top lift and storage system 10 is positioned such that rear hook 540 may be connected to vehicle top 800 at the rear window 898. Rear hook 540 may be a general purpose hook or a hook specially configured to interact with a window of a vehicle top such as those described in co-pending patent application Ser. No. 14/177,141, filed Feb. 10, 2014, the disclosure of which is incorporated herein by this reference. Carabineer 550 is connected to strap 560, which connects to the sides 894 of vehicle top 800. Strap 560 may connect to sides of vehicle top 800 by the use of screws, bolts, pins, ties, or other attachment means. For example, in one embodiment, strap 560 connects to the sides 894 of vehicle top 800 via a lynch pin in connection with holes in strap 560 and sides 894 of vehicle top 800. In other embodiments, strap 560 may make a complete loop that encircles around vehicle top 800. In other embodiments strap 560 may be connected to hooks that are used to engage vehicle top 800. In yet other embodiments, attachment mechanisms may attach cables of lift mechanism 500 to other portions of vehicle top 800 in order to facilitate removal of the vehicle top 800 from vehicle 801.

Vehicle top 800 may be connected to vehicle 801 through clips, latches, pins, or other attachment devices. The exact attachment mechanisms for attaching a vehicle top to a vehicle may depend on the vehicle manufacturer, the vehicle top manufacturer, or attachment mechanisms provided by a user of the vehicle. The attachment mechanisms, if any, for vehicle top 800 may be disengaged so that removable vehicle top 800 may be freely moved away from vehicle 801. Once disengaged from vehicle 801, vehicle top 800 may be lifted through the use of lift mechanism 500. Once vehicle top 800 is lifted away from vehicle 801, vehicle 801 may then be moved away from vehicle top lift and storage system 10, or, alternatively, vehicle lift and storage system 10 may be moved away from vehicle 801.

Figure 3:
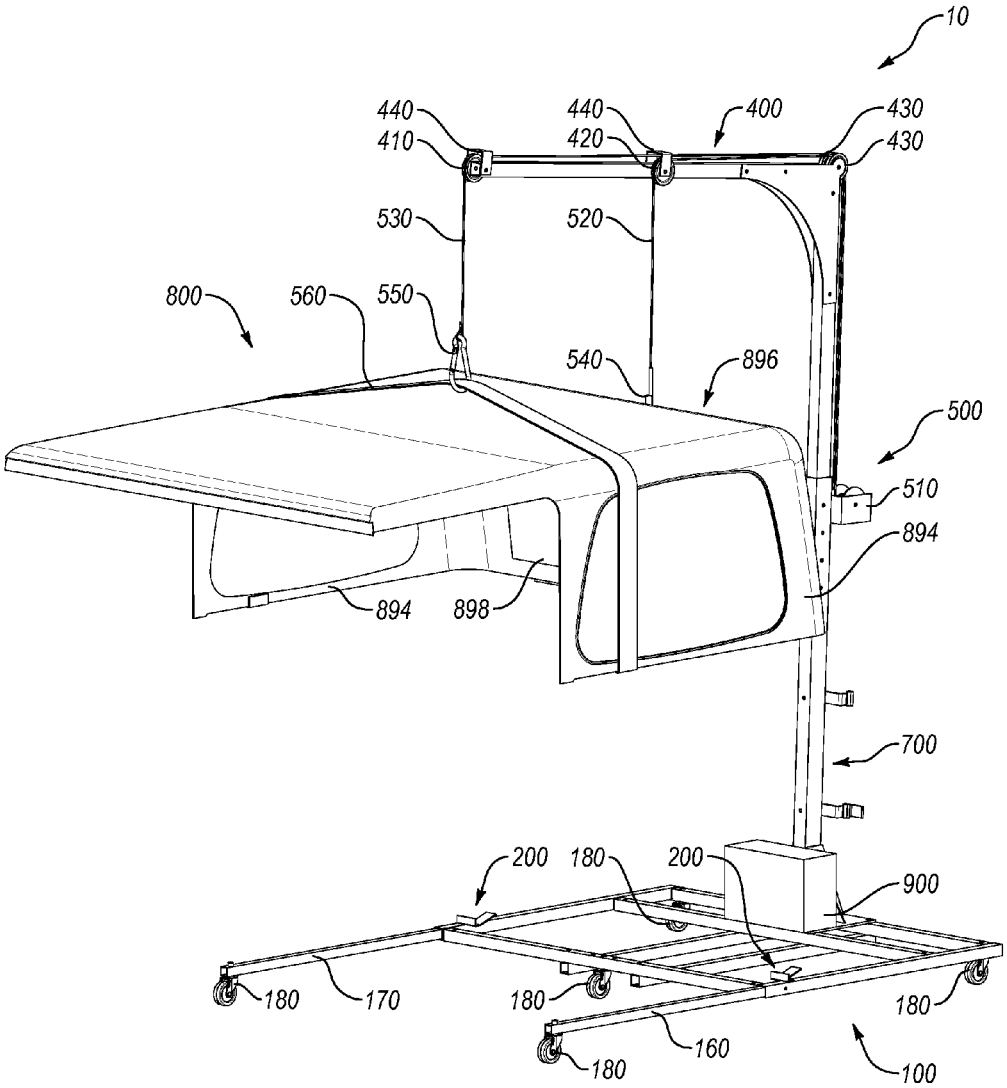
FIG. 3 is a perspective view of a vehicle top lift and storage system in which a vehicle top is shown suspended from the vehicle top lift and storage system.

FIG. 3, shows one embodiment of vehicle top lift and storage system 10 used in connection with the removal of vehicle top 800, wherein the vehicle top 800 has been removed from vehicle 801. As shown vehicle top 800 suspends from lift arm 400 by the lift mechanism 500 in connection with strap 560 and rear hook 540.

FIG. 3 also shows block 900 positioned on base 100. As will be described with reference to the other figures, vehicle top 800 may rest on block 900 while vehicle top 800 is stored on vehicle top lift and storage system 10. In one embodiment, block 900 is a solid foam block. In other embodiments, block 900 may be constructed of other materials.

Figure 4:
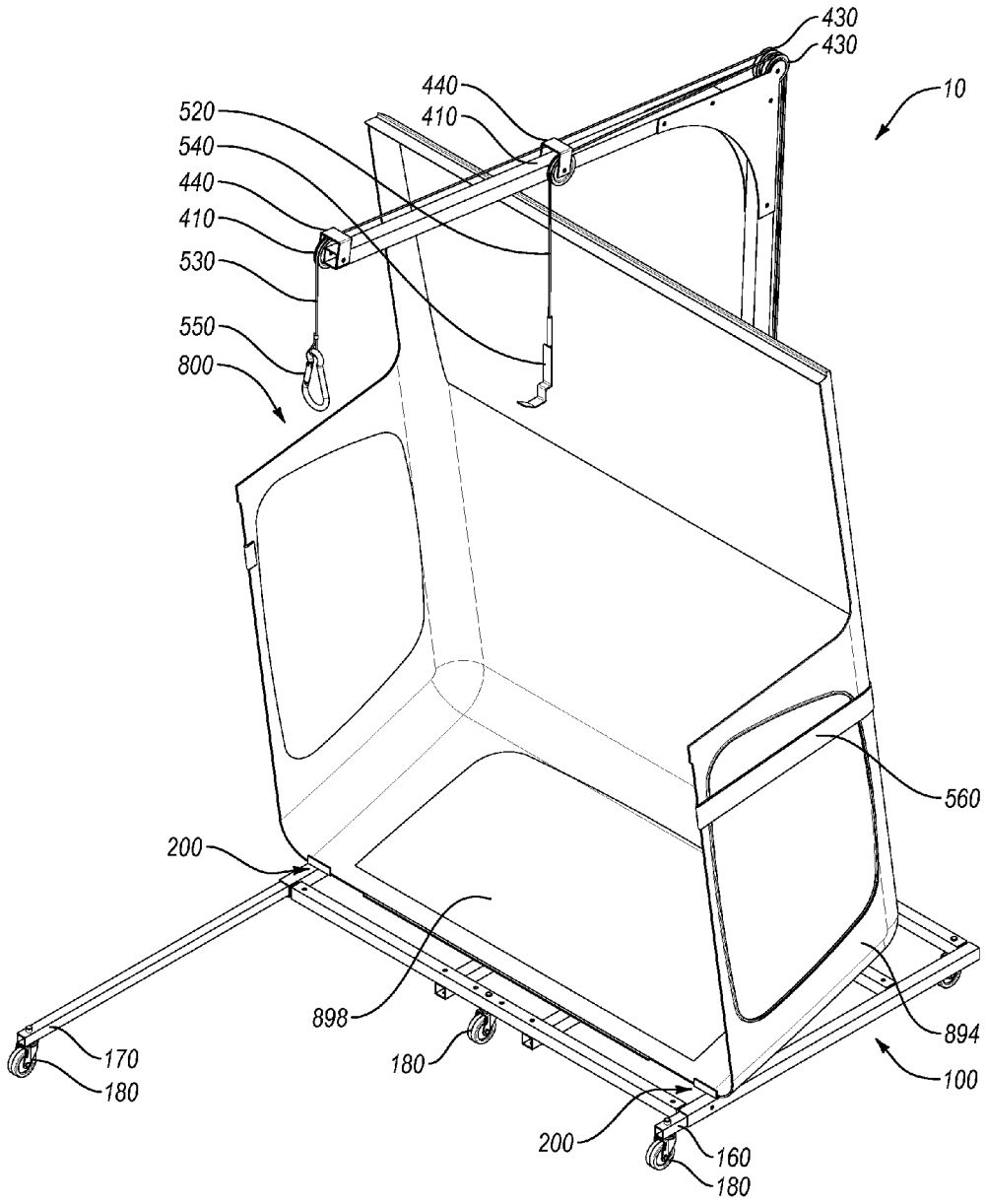
FIG. 4 is a perspective view of a vehicle top lift and storage system in which a vehicle top is shown in a storage position on the vehicle top lift and storage system.

FIG. 4 shows one embodiment of vehicle top lift and storage system 10 used in connection with the storage of vehicle top 800. A user of vehicle top lift and storage system 10 may carefully lower and rotate vehicle top 800 from a lifted position, shown in FIG. 3, to a storage position, shown in FIG. 4. As shown, retainers 200 may receive a portion of the rear 896 of vehicle top 800. As vehicle top 800 is lowered and rotated into the storage position, rear window 898 may tend to open due to gravitational or other forces. As will be described in connection with other figures, the configuration of retainers 200, including flanges, may limit or prevent the undesired opening of rear window 898 of vehicle top 800. Also, and as will be further shown in FIG. 7, vehicle top 800 may rest on or be received by block 900.

While vehicle top 800 is in the storage position, rear hook 540 may be detached from the rear 896 of vehicle top 800. Carabineer 550 may also be detached from strap 560, or strap 560 may be detached from the sides 894 of vehicle top 800. Alternatively, strap 560, carabineer 550, or rear hook 540 may remain attached in order to facilitate the speedy reattachment of vehicle top 800 to vehicle 801 using lift mechanism 500.

FIG. 4 also shows base arm 160 in a retracted position and base arm 170 in an extended position. Base arm 160 in the retracted position shows how the base arms of a vehicle top lift and storage system may be retracted or otherwise moved to reduce the overall footprint of a vehicle top lift and storage system.

Figure 5:
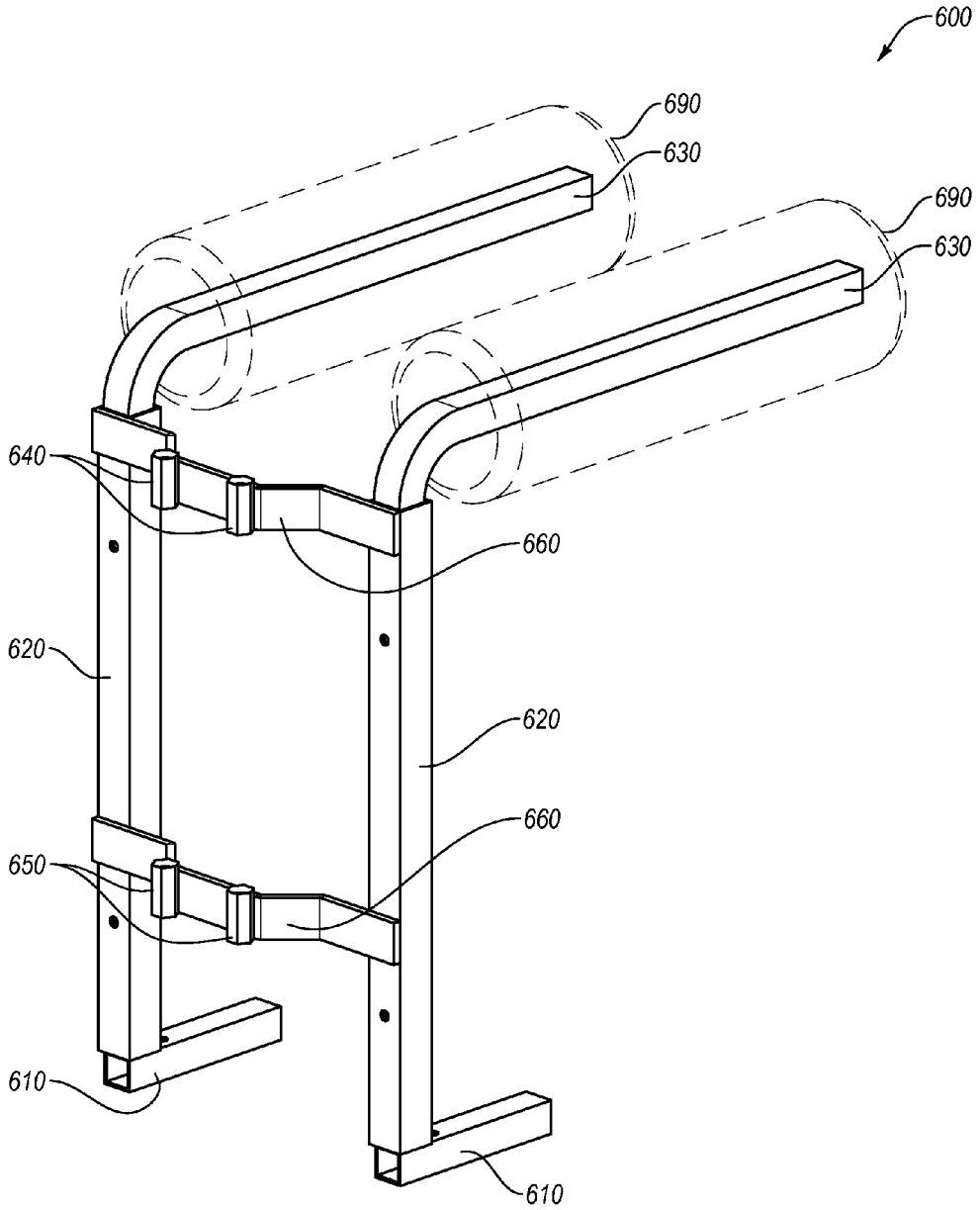
FIG. 5 is a perspective view of an accessory holder for use with a vehicle top lift and storage system.

FIG. 5 shows one embodiment of accessory storage module 600 in further detail. Accessory storage module 600 includes attachment portions 610, vertical portions 620, and storage portions 630. Attachment portions 610 are configured to connect to vehicle top lift and storage system 10, through for example, insertion into hollow sections of support members 150 of base 100. Vertical portions 620 are connected to attachment portions 610 and may comprise a single piece or, alternatively, may comprise multiple pieces. Vertical portions 620 may also be selectively extendible in order to adjust the height of accessory storage module 600. Suitable mechanisms for the selective extendibility have already been described herein or will otherwise be appreciated by those of skill in the art. Storage portions 630 are connected to vertical portions 620 and are configured such that vehicle accessories may rest thereon. Such vehicle accessories may include additional pieces of a vehicle top, removable vehicle doors, or other accessories.

Braces 660 are connected to and extend between vertical portions 620. Braces 660 also include upper hollow cylinders 640 and lower hollow cylinders 650. Upper hollow cylinders 640 and lower hollow cylinders 650 are configured to receive pins from hinge-sections of removable doors 880 from vehicle 801. The pins of removable doors 880 of vehicle 801 may be inserted into the upper hollow cylinders 640 and lower hollow cylinders 650 for storage of the removable doors 880.

Figure 6:
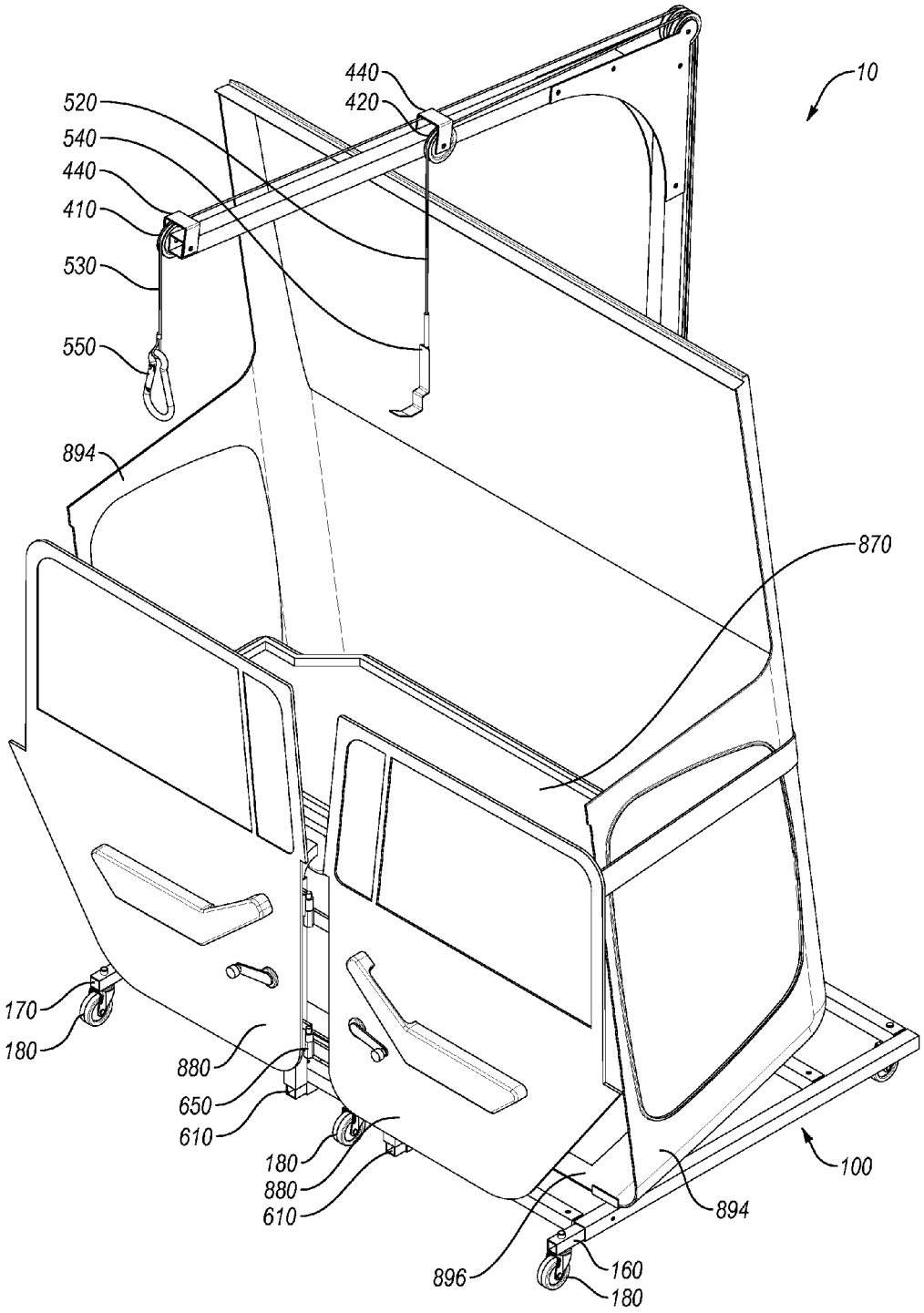
FIG. 6 is another perspective view of a vehicle top lift and storage system in which a vehicle top is shown in a storage position with an accessory holder attached to the vehicle top lift and storage system.

FIG. 6 shows one embodiment of vehicle top lift and storage system 10 with vehicle top 800 stored thereon. Accessory storage module 600 is connected to base 100 of vehicle top lift and storage system 10. Removable doors 880 are shown as stored using the upper hollow cylinders 640 and lower hollow cylinders 650 of accessory storage module 600. Additional vehicle top pieces 870 are shown stored atop storage portions 630 of storage module 600. Additional vehicle top pieces 870 may include additional pieces of a vehicle top that is not removable as a single piece.

The attachment and configuration of accessory storage module 600 may also be used to help secure or to limit unwanted movement of vehicle top 800 during storage. In some embodiments lift arm 400 may be configured to fold down toward upright member 300. Lift arm 400 may thus be used to help secure or to limit unwanted movement of vehicle top 800 during storage.

Base arm 160 and base arm 170 are shown in retracted positions in FIG. 6. Refraction of base arm 160 and base arm 170 reduces the overall area or footprint of vehicle top lift and storage system 10, while still maintaining the movability of vehicle top lift and storage system 10.

Base 100, upright member 300, accessory storage module 600, or other portions of vehicle top lift and storage system 10 may include padding to cushion or prevent damage to vehicle top 800 during the use of vehicle top lift and storage system 10. Padding may also help limit unwanted movement of vehicle top 800 or accessories during storage. Cords, such as rope or bungee cords, may also be used to help secure vehicle top 800 or accessories to vehicle top lift and storage system 10.

Figure 7:
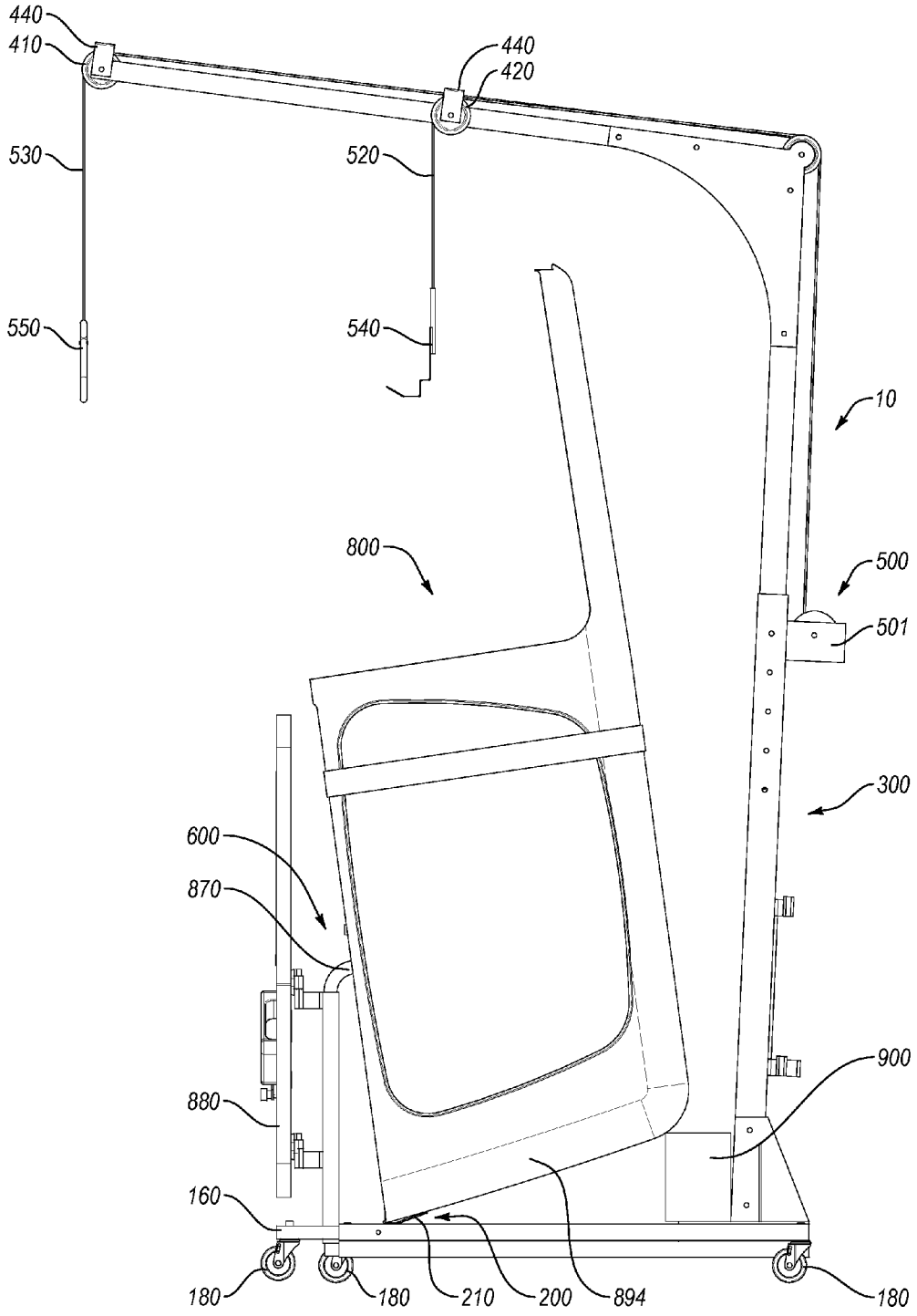
FIG. 7 is an elevation view of the vehicle top lift and storage system of FIG. 6.

FIG. 7 shows one embodiment of vehicle top lift and storage system 10 with vehicle top 800 stored thereon. FIG. 7 shows how block 900 may be used to position vehicle top 800 at an angle so that rear 896 of vehicle top 800 is not entirely resting on base 100. Block 900 may be of any configuration to situate vehicle top 800 into a desired storage position. Retainers 200 are also shown receiving a portion of vehicle top 800. Flanges 210 of retainers 200 help to cradle vehicle top 800 while in a storage position and also may limit unwanted opening of rear window 898 of vehicle top 800 during storage.

Figure 8:
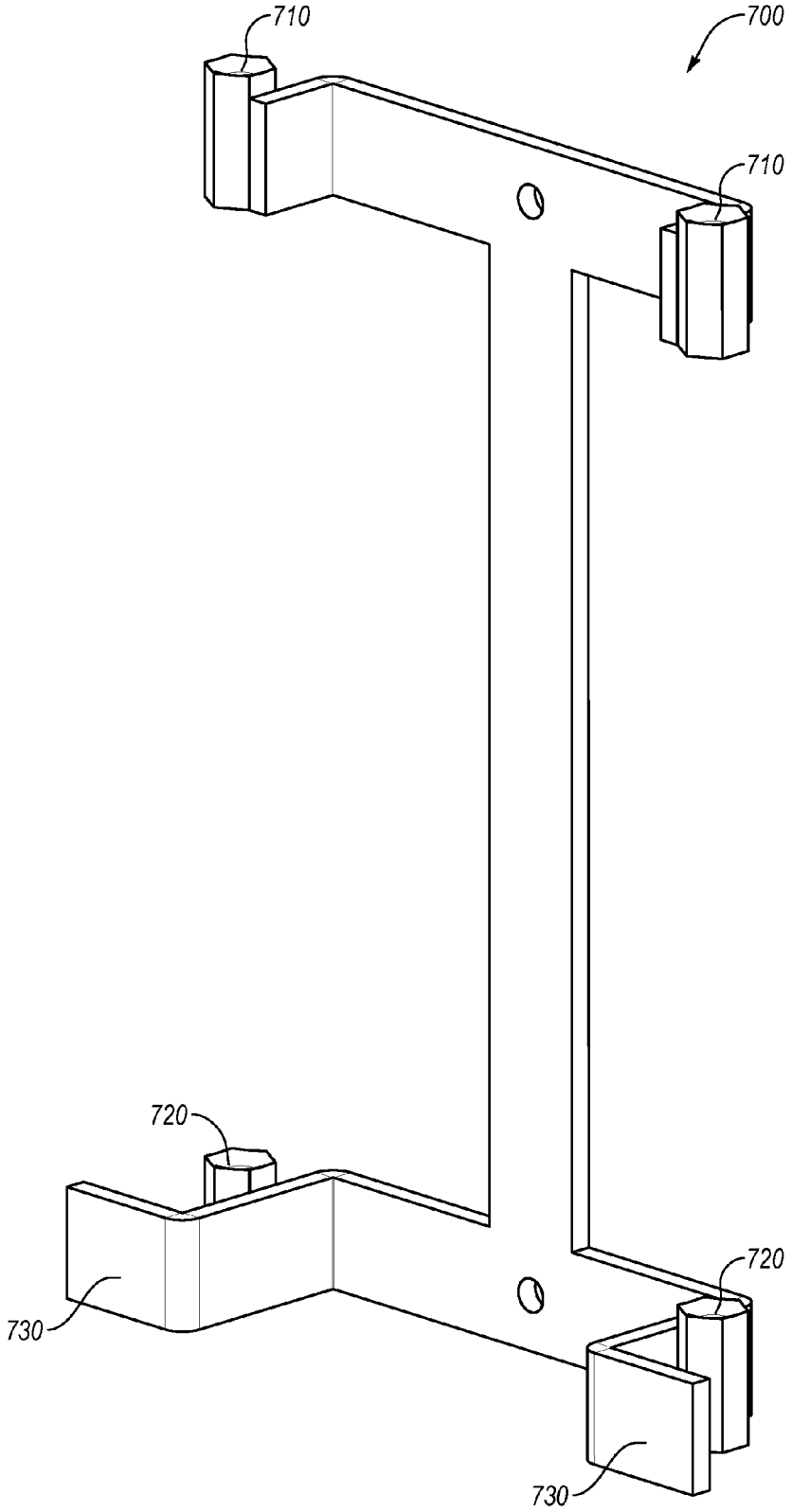
FIG. 8 is a perspective view of a door holder for use in connection with a vehicle top lift and storage system.

FIG. 8 shows one embodiment of door holder 700 in further detail. Door holder 700 includes upper hollow cylinders 710 and lower hollow cylinders 720, and flanges 730. Door holder 700 may be attached to upright member 300 of vehicle top lift and storage system 10 through the use of pins, screws, bolts, ties, or other fasteners. Upper hollow cylinders 710 and lower hollow cylinders 720 are configured to receive pins from hinge-sections of removable doors 880 from vehicle 801. The pins of removable doors 880 of vehicle 801 may be inserted into the upper hollow cylinders 710 and lower hollow cylinders 720 for storage of the removable doors 880. Flanges 730 limit or prevent unwanted rotation of removable doors 880 during storage. Flanges 730 may also include rubber tips or other padding to cushion, prevent damage, or prevent unwanted movement of removable doors 880 that are stored using door holder 700.

Figure 9:
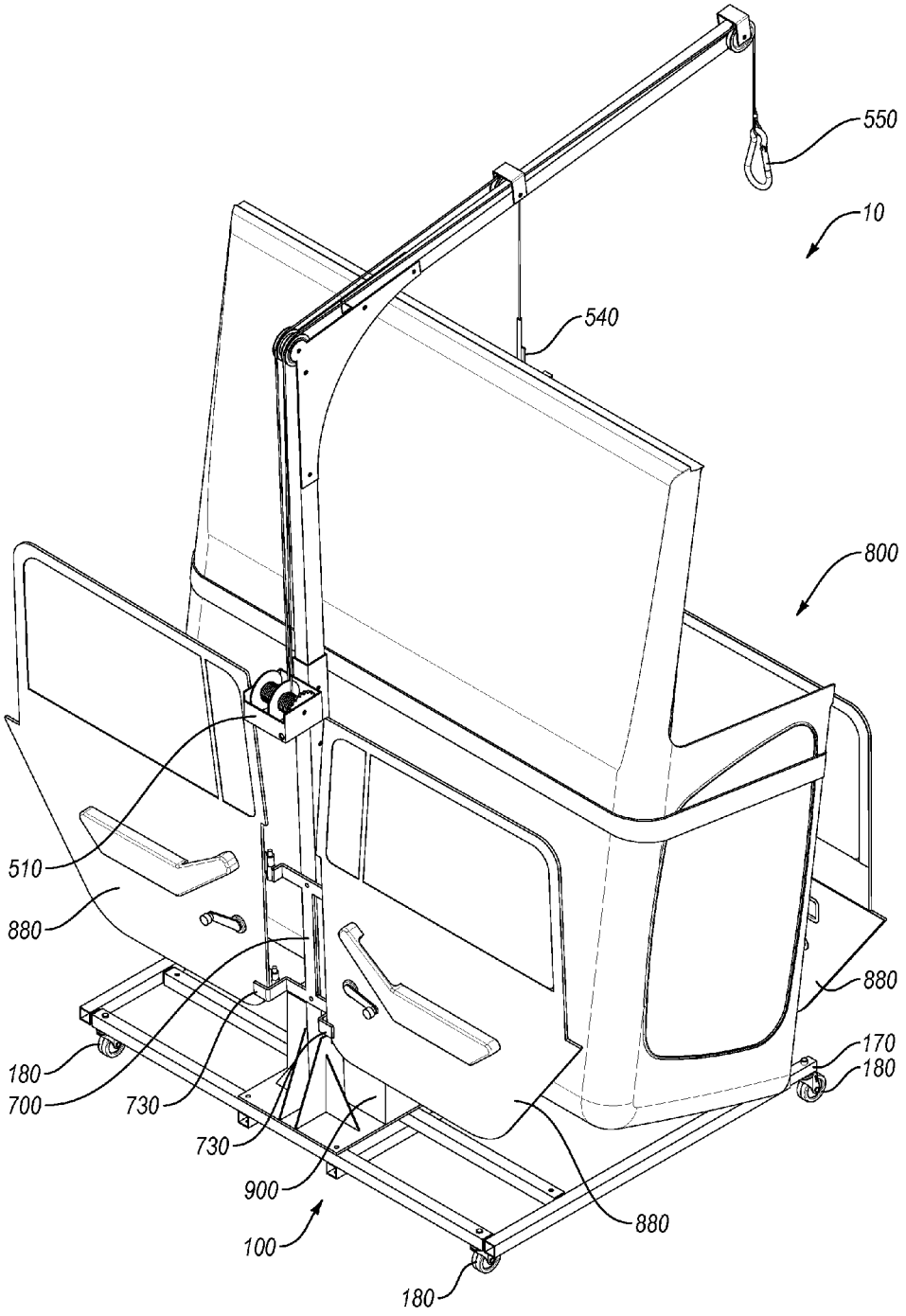
FIG. 9 is a perspective view of a vehicle top lift and storage system in which vehicle doors are shown in a storage position in connection with the door holder of the vehicle top lift and storage system.

FIG. 9 shows one embodiment of vehicle top lift and storage system 10 with vehicle top 800 stored thereon. Removable doors 880 are shown stored using the upper hollow cylinders 710 and lower hollow cylinders 720 of door holder 700. As can be seen in FIG. 9, flanges 730 limit the rotation of removable doors 880 stored using door holder 700. Vehicle top 800 may also limit the rotation of removable doors 880 while removable doors 880 are stored using door holder 700. With reference again to FIG. 8, the alignment of upper hollow cylinders 710 and lower hollow cylinders 720 may also be adjusted to compensate for any tilt or angle of upright member 300. For example, if upright member 300 is attached to base 100 at a slight angle, the positions of upper hollow cylinders 710 and lower hollow cylinders 720 may be adjusted so that upper hollow cylinders 710 and lower hollow cylinders 720 are substantially aligned on a vertical plane. Adjusted alignment of upper hollow cylinders 710 and lower hollow cylinders 720 on door holder 700, may limit unwanted rotation of removable doors 880 stored using door holder 700, which may otherwise be caused by misalignment of the hollow cylinders.

As with other portions of vehicle top lift and storage system 10, door holder 700 may include padding to cushion or prevent damage to vehicle top 800, removable doors 880, or other accessories during the use of vehicle top lift and storage system 10. Additionally, cords, such as rope or bungee cords, may also be used to help secure removable doors 880 or accessories to door holder 700 or vehicle top lift and storage system 10.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A vehicle top lift and storage system comprising:

a portable base;

one or more base arms configured to selectively extend away from the base, wherein the one or more base arms is each selectively extendible between an extended position and a retracted position;

at least one retainer coupled to the base, wherein the at least one retainer is configured to engage at least a portion of a vehicle top when the vehicle top is resting on the vehicle top lift and storage system in a storage position and when the one or more base arms is in its retracted position;

an upright member coupled to the base;

a lift arm coupled to and extending away from the upright member; and an attachment strap configured to attach to sides of the vehicle top;

a forward cable coupled to the attachment strap at a first end of the forward cable, wherein the forward cable suspends from the lift arm;

a rear hook configured to attach to a rear portion of the vehicle top and to allow a rear window of the vehicle top to at least partially close while the vehicle top lift and storage system is in use;

a rear cable coupled to the rear hook at a first end of the rear cable, wherein the rear cable also suspends from the lift arm;

wherein the forward cable the rear cable are configured to lift the vehicle top from a vehicle and suspend and aid in placement of the vehicle top for storage on the vehicle top lift and storage system.

2. The vehicle top lift and storage system of claim 1 further comprising at least one base arm configured to selectively extend away from the base, wherein the at least one base arm is selectively extendible between an extended position and a retracted position.

3. The vehicle top lift and storage system of claim 1 further comprising a selectively removable accessory storage module.

4. The vehicle top lift and storage system of claim 1 further comprising a door storage member coupled to the upright member, wherein the door storage member comprises at least one hollow cylinder configured to receive a pin of a door hinge.

5. The vehicle top lift and storage system of claim 1, wherein the lift arm is configured to selectively extend between a first position and a second position.

6. The vehicle top lift and storage system of claim 1, wherein the forward cable is attached to a winding mechanism at a second end of the forward cable, and where the rear cable is attached to the winding mechanism at a second end of the forward cable.

7. The vehicle top lift and storage system of claim 6, wherein the winding mechanism is configured to simultaneously wind the forward cable and the rear cable.

8. The vehicle top lift and storage system of claim 6, wherein the winding mechanism coupled to the rear cable and the winding mechanism coupled to the forward cable are the same winding mechanism.

9. The vehicle top lift and storage system of claim 1 further comprising at least one selectively movable pulley coupled to the lift arm.

10. The vehicle top lift and storage system of claim 1, wherein the upright member is selectively extendible between a lowered position and a heightened position.

11. The vehicle top lift and storage system of claim 1, wherein the base is a portable base that comprises at least one wheel.

12. A vehicle top lift and storage system comprising:

a portable base;

one or more retractable base arms configured to selectively extend from the base, wherein the one or more base arms is each selectively extendible between an extended position in which the one or more retractable base arms extends size of the base and a retracted position in which the one or more retractable base arms retracts within the base;

at least one retainer coupled to the base, wherein the at least one retainer is configured to engage at least a portion of a vehicle top when the vehicle top is resting on the vehicle top lift and storage system in a storage position and when the one or more base arms is in its retracted position;

an upright member coupled to the base;

a lift arm coupled to and extending away from the upright member; and an attachment strap configured to attach to sides of the vehicle top;

a forward cable coupled to the attachment strap at a first end of the forward cable, wherein the forward cable suspends from the lift arm;

a rear hook configured to attach to a rear portion of the vehicle top and to allow a rear window of the vehicle top to at least partially close while the vehicle top lift and storage system is in use;

a rear cable coupled to the rear hook at a first end of the rear cable, wherein the rear cable also suspends from the lift arm;

wherein the forward cable the rear cable are configured to lift the vehicle top from a vehicle and suspend and aid in placement of the vehicle top for storage on the vehicle top lift and storage system.

13. The vehicle top lift and storage system of claim 12, wherein the portable base comprises at least one wheel, and wherein the at least one base arm comprises at least one wheel.

14. The vehicle top lift and storage system of claim 12, wherein the forward cable is attached to a winding mechanism at a second end of the forward cable, and where the rear cable is attached to the winding mechanism at a second end of the forward cable.

15. The vehicle top lift and storage system of claim 14, wherein the winding mechanism is configured to simultaneously wind the forward cable and the rear cable.

16. The vehicle top lift and storage system of claim 14, wherein the winding mechanism coupled to the rear cable and the winding mechanism coupled to the forward cable are the same winding mechanism.

17. The vehicle top lift and storage system of claim 12 further comprising at least one selectively movable pulley coupled to the lift arm.

18. The vehicle top lift and storage system of claim 12, wherein the upright member is selectively extendible between a lowered position and a heightened position.

19. The vehicle top lift and storage system of claim 12 further comprising a selectively removable accessory storage module.

20. A vehicle top lift and storage system comprising:

a portable base having a front side and a rear side;

one or more base arms configured to selectively extend away from the front side of the base, wherein the at least one base arm comprises at least one wheel, and wherein the one or more base arms is each selectively extendible between an extended position and a retracted position;

at least one retainer coupled to the base, wherein the at least one retainer is configured to engage at least a portion of a vehicle top when the vehicle top is resting on the vehicle top lift and storage system in a storage position and when the one or more base arms is in its retracted position;

an upright member having a lower portion and an upper portion, wherein the lower portion of the upright member is coupled to the front side of the base;

a lift arm coupled to and extending away from the upper portion of the upright member; and an attachment strap configured to attach to sides of the vehicle top;

a forward cable coupled to the attachment strap at a first end of the forward cable, wherein the forward cable suspends from the lift arm;

a rear hook configured to attach to a rear portion of the vehicle top and to allow a rear window of the vehicle top to at least partially close while the vehicle top lift and storage system is in use;

a rear cable coupled to the rear hook at a first end of the rear cable, wherein the rear cable also suspends from the lift arm;

wherein the forward cable the rear cable are configured to lift the vehicle top from a vehicle and suspend and aid in placement of the vehicle top for storage on the vehicle top lift and storage system.

* * * * *